United States Patent [19]

Banks

[11] 4,211,885

[45] Jul. 8, 1980

[54] HIGH OCTANE GASOLINE COMPONENTS FROM CATALYTIC CRACKING GASOLINE, PROPYLENE, AND ISOBUTANE BY DISPROPORTIONATION, CLEAVAGE AND ALKYLATION

[75] Inventor: Robert L. Banks, Bartlesville, Okla.

[73] Assignee: Phillips Petroleum Company, Bartlesville, Okla.

[21] Appl. No.: 39,405

[22] Filed: May 15, 1979

[51] Int. Cl.[2] ..... C07C 3/62; C07C 3/50

[52] U.S. Cl. ..... 585/316; 585/331; 585/644; 585/717

[58] Field of Search ..... 585/331, 315, 316, 644

[56] References Cited

U.S. PATENT DOCUMENTS

| | | | |
|---|---|---|---|
| 3,763,032 | 10/1973 | Banks | 585/331 |
| 3,767,565 | 10/1973 | Banks | 585/331 |
| 3,785,956 | 1/1974 | Banks | 585/331 |
| 3,785,957 | 1/1974 | Banks | 585/331 |

*Primary Examiner*—George Crasanakis

[57] ABSTRACT

High octane gasoline is produced from cat cracked gasoline by cleaving the $C_5$ olefins in the gasoline with ethylene in a first disproportionation zone. The effluent is separated to produce a $C_5$+ stream, a first butenes stream and an ethylene-propylene stream. The ethylene-propylene stream is passed to a second disproportionation or cleavage zone along with additional propylene supplied from an external source. The effluent is separated to produce ethylene which is passed to the first disproportionation zone and a second stream of butenes. The butenes stream are combined and passed to an alkylation zone where it is alkylated with isobutane. The alkylate and remaining gasoline ($C_5$+ stream) can be combined to produce a product higher in octane value than cat cracked gasoline.

2 Claims, 1 Drawing Figure

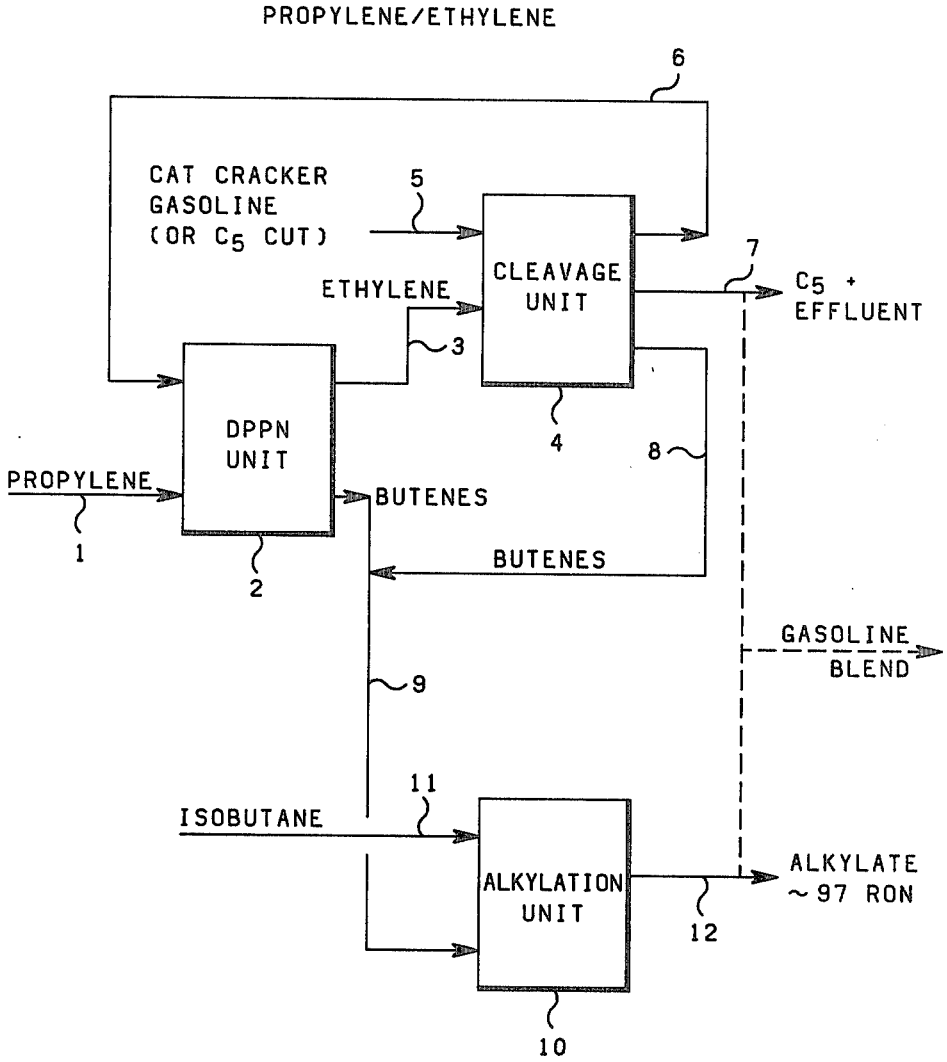
PROPYLENE/ETHYLENE
6
CAT CRACKER
GASOLINE
(OR $C_5$ CUT)
5
CLEAVAGE
UNIT
7
$C_5$ +
EFFLUENT
ETHYLENE
3
DPPN
UNIT
4
8
PROPYLENE
1
BUTENES
2
BUTENES
GASOLINE
BLEND
9
11
ISOBUTANE
ALKYLATION
UNIT
ALKYLATE
~97 RON
12
10

HIGH OCTANE GASOLINE COMPONENTS FROM CATALYTIC CRACKING GASOLINE, PROPYLENE, AND ISOBUTANE BY DISPROPORTIONATION, CLEAVAGE AND ALKYLATION

BRIEF SUMMARY OF THE INVENTION

The invention relates to the production of high octane gasoline components. It also relates to a combination operation in which so-called disproportionation, cleavage and alkylation are practiced. More specifically, the invention relates to an energy-saving, less expensive combination of steps so conceived as to permit use of relatively cheaper propylene rather than ethylene as the olefin feed stock to a disproportionation unit.

In one of its concepts the invention provides a process in which an olefin feed consisting substantially of propylene is passed to a disproportionation operation to produce ethylene and butene, the ethylene is passed together with a catalytic cracking gasoline into a cleavage operation, a stream of propylene and ethylene obtained from the cleavage operation is passed to the disproportionation operation, and butenes produced in the disproportionation operation and in the cleavage operation are passed together with isobutane to an alkylation operation. A gasoline component containing fraction is obtained from the cleavage unit and also from the alkylation unit. These last two components can be blended, as desired.

BRIEF DESCRIPTION OF DRAWING

The drawing shows diagrammatically a disproportionation unit, a cleavage unit and an alkylation unit in which the invention can be practiced.

DETAILED DESCRIPTION

Referring now to the drawing, propylene is fed by 1 to the disproportionation unit 2 wherein disproportionation under conditions of disproportionation suitable for disproportionating propylene to produce ethylene and butylene are maintained. From unit 2, ethylene is passed by 3 to cleavage unit 4 wherein cleavage is practiced upon it and a catalytic cracking gasoline fed by 5 into unit 4. The conditions in unit 4 are such as to cause cleavage of the admixture of hydrocarbons therein to produce a propylene/ethylene stream 6, a $C_5$ plus stream 7, and a butene streams 8. The last mentioned stream is passed together with butenes stream 9 from disproportionation unit 2 into alkylation unit 10 wherein alkylation of isobutane fed by 11 takes place to produce an alkylate 12. Stream 6 is cycled to disproportionation unit 2.

A number of operations or schemes have been proposed or disclosed to incorporate propylene disproportionation with alkylation to yield higher octane number gasoline. Such schemes require a diisopropyl unit or a high purity ethylene.

From the foregoing description and that which follows it is evident to one skilled in the art possessed of this disclosure and having studied the same that ethylene, as such, is not required as an olefin feed stock from external source for my disproportionation operation.

Thus, in my process, the ethylene is produced in the disproportionation unit and is then used to cleave $C_5$ olefins in catalytic gasoline to provide additional ethylene, and butenes for alkylation. My invention will increase alkylate yield by about 70 percent over direct alkylation of propylene and also will provide alkylate that is from about 5 to about 7 octane units higher than propylene alkylate or typical catalytic cracking gasoline.

It is noteworthy that energy savings and cost reduction, including less expensive total fractionation costs, are possible in the operation of the invention.

One skilled in the art in possession of this disclosure, having studied the same, can readily select feed stocks or starting materials for practicing the present invention.

The following patents are examples of related prior art. Their disclosures are incorporated herein by this reference to them.

U.S. Pat. No. 3,763,032, issued Oct. 2, 1973, Robert L. Banks, discloses a process for converting an olefinic gasoline to a higher octane value gasoline which comprises the steps of subjecting the feed gasoline, or a fraction thereof, to olefin disproportionation in the presence of added ethylene to convert some of the heavier olefins to lighter olefins, disproportionating propylene produced by the first step to ethylene and butenes, alkylating the butenes with isobutane, catalytically reforming a $C_5+$ fraction from the first step, and recombining the alkylate and reformate with unconverted gasoline fractions to form the higher octane gasoline.

U.S. Pat. No. 3,767,565, issued Oct. 23, 1973, Robert L. Banks, discloses a process for increasing the octane value of an olefinic gasoline by subjecting the same to separation to provide a $C_5$ cut containing both linear and branched $C_5$ olefins, reacting the $C_5$ cut with added ethylene in the presence of an olefin disproportionation catalyst to produce isobutene and propylene, disproportionating the produced propylene to provide ethylene and n-butenes, alkylating the n-butenes with isobutane to provide a high octane alkylate, dimerizing produced isobutene to provide diisobutylene, reacting the diisobutylene with ethylene to provide isohexenes, and recombining the high octane alkylate, isohexenes, and the remaining olefinic gasolines to provide an upgraded gasoline having increased octane ratings.

U.S. Pat. No. 3,785,956, issued Jan. 15, 1974, Robert L. Banks, discloses that the disproportionation of mixtures of branched and unbranched disproportionatable olefins in the presence or absence of ethylene is improved by adjusting the conversion to a specified level thereby increasing the selectivity of the reaction to the conversion of the unbranched olefins. The process has particular utility in increasing of the quality of olefinic gasoline streams in that the lower octane-rated unbranched olefins can be selectively removed from the gasoline by conversion to other olefins while substantially retaining the higher octane-rated branched olefins. According to the patent there is provided a process for increasing the octane value of olefinic gasoline streams which comprises the steps of separating a $C_5$ fraction from an olefinic gasoline stream, the $C_5$ fraction containing both pentenes and isopentenes, selectively disproportionating the $C_5$ stream, with or without the presence of added ethylene to convert more of the normal pentenes than the isopentenes, alkylating the resulting butenes and lighter olefins with isobutane, and combining the alkylate and remaining gasoline to provide a high octane gasoline having a reduced light olefins content. The patent also discloses that in a modification of the above described multistep process produced propylene is disproportionated in a second olefin disproportionation zone, to provide additional butenes for alkylation and ethylene for reaction with n-pentenes in the first step of the process.

U.S. Pat. No. 3,785,957, issued Jan. 15, 1974, Robert L. Banks, discloses a process for increasing the octane value of olefincontaining gasoline streams comprises disproportionating the olefinic gasoline with ethylene, separating the effluent to provide a propylene stream, a butene stream, a $C_5$ or $C_5$–$C_6$ olefin stream, and a $C_6$+ or $C_7$+ gasoline stream, disproportionating the $C_5$ or $C_5$–$C_6$ olefin stream with ethylene to provide additional propylene and butenes, optionally disproportionating the produced propylene to provide additional ethylene and butenes, alkylating all the produced butenes with isobutane to provide a high octane alkylate and combining the high octane alkylate, and $C_6$+ or $C_7$+ olefin gasoline streams to provide the high octane gasoline stream.

The foregoing patents appear to use ethylene as the olefin added, when one is added, for use as the olefin feed from external source to the disproportionation zone or operation.

The present invention, however, does not require the production of the added ethylene, or pure ethylene, which would necessitate a propylene/ethylene disproportionation operation which is expensive and energy-consuming along with the needed relatively much more expensive fractionation operations.

It is an object of this invention to produce high octane value gasoline components. It is another object of the invention to provide steps in combination, including a disproportionation operation, the feed stock to which is less expensive than is ethylene. A further object of the invention is to make use of less expensive feed stock yet to so arrange disproportionation, cleavage and alkylation operations as to produce improved yields of higher octane number or value gasoline components.

Other aspects, concepts, objects, and several advantages of this invention are apparent from a study of this disclosure, the drawing and the appended claims.

According to the present invention there is provided a process including in combination the following steps: a propylene disproportionation, a cleavage of a mixture of ethylene and catalytic cracking gasoline and an alkylation of isoparaffin with butenes produced in and obtained from the disproportionation and cleavage operations, a mixture of propylene and ethylene resulting from the cleavage operation being cycled to the disproportionation operation.

Generally, to more fully describe the invention as an aid to one skilled in the art, starting materials for the process of the invention include: an olefin-containing gasoline having at least about 10 weight percent olefinic hydrocarbons, propylene and isobutane. No other feed stock from external source is needed, even as can be appreciated from a consideration of the description of the drawing given above.

Also according to the invention a mixture of olefin-containing gasoline and ethylene in the cleavage unit is converted in the presence of an olefin disproportionation catalyst, thus producing the already described stream comprising propylene and ethylene, butenes, and a $C_5$+ gasoline fraction.

The high octane alkylate which is produced in the alkylation operation can be blended with the $C_5$+ gasoline fraction resulting from the cleavage unit and/or with other gasolines and/or used by itself depending upon circumstances.

A tungsten oxide/silica/catalyst containing about 8 wt. % $WO_3$ and 92 wt. % catalyst grade silica is presently preferred in the cleavage and in the disproportionation units because of its high level of durability and activity. Any other catalyst which will function to yield the result here noted can be used.

The catalyst used in the alkylation unit can be any one that under known alkylation conditions will provide a high octane alkylate. A suitable catalyst is hydrofluoric acid employed at a temperature of about 80° to 100° F. (27° to 38° C.), a contact time of 1 to 10 minutes and a suitable isobutane to olefin mole ratio of about 4:1 to 15:1.

The olefin-containing gasoline can contain from about 10 to about 70 wt. % olefinic hydrocarbons and preferably will have an end point not exceeding about 450° F. (232° C.). Such gasolines are readily available as products of a catalytic cracker. If desired, the full range cat cracker gasoline can be fractionated to obtain a $C_5$+ cut, for example, which is richer in olefins and paraffins and can be employed as a feedstock in the process.

The reaction conditions employed in the cleavage and disproportionation units are generally somewhat similar. Pressures can range from about 15 to 2000 psia (0.10 to 13.8 MPa), more preferably from about 40 to 520 psia (0.27 to 3.6 MPa). Temperatures can range from about 400° to 1100° F. (204° to 593° C.), more preferably from about 600° to 900° F. (316° to 482° C.). Weight hourly space velocities over the solid catalyst can vary widely from about 0.1 to 1,000 and more preferably from about 1 to 500.

The following is an example calculated based upon knowledge and experience.

A cat cracker gasoline having a 90° to 242° F. (32.2° to 116.7° C.) boiling range, an API gravity of 71.2 at 60° F. (15.6° C.), a RON-clear of 94.4 and a MON-clear of 79.1 is used as the gasoline feedstock. The gasoline, by gas-liquid chromatographic analysis, contains 64.7 wt. % olefinic hydrocarbons, 6.1 wt. % aromatics, 2.9 wt. % n-paraffins, 22.6 wt. % isoparaffins and 3.7 wt. % $C_4$−. The bromine number is 114.

The cleavage unit (4) is operated at 750° F. (398.9° C.), a pressure of 314.7 psia (2.17 MPa) and a WHSV of 50. The catalyst is 8.5 wt. % $WO_3$ and 91.5 wt. % $SiO_2$ having a surface area of 275 $m^2/g$ and a pore volume of 0.80 cc/g.

The disproportionation unit (2) is operated at 725° F. (385° C.), a pressure of 339.7 psia (2.34 MPa) and a WHSV of 30. A catalyst like that of the cleavage zone is employed.

The alkylation unit (10) is operated at 85° F. (29.4° C.), a pressure of 139.7 psia (0.96 MPa), a contact time of about three minutes and a hydrofluoric acid/hydrocarbon volume ratio of 1:1 (equivalent to a mole ratio of about 5:1).

The cleavage unit 4 is charged with a feedstock consisting of 20,367 kg/hr of the described cat cracker gasoline and 19,000 kg/hr of an ethylene/propylene mixture. The gasoline charged can be further described in terms of 19,617 kg/hr of $C_5$+ gasoline, 2 kg/hr of propylene, 37 kg/hr of isobutane and 711 kg/hr of butenes. The ethylene/propylene, can be further described in terms of 18,720 kg/hr of ethylene and 280 kg/hr of propylene. The effluent is passed to a first separation zone containing one or more fractionators (not shown). The separated ethylene/propylene stream, amounting to 19,791 kg/hr is passed to a second separation zone, a part of Unit 2 consisting of a first fractionator where the propylene is separated and passed to the disproportionation reactor and a second fractionator to be subsequently described. The stream comprises 16,696 kg/hr of ethylene and 3,095 kg/hr of propylene. The butenes, 2,752 kg/hr and isobutane, 240 kg/hr, from the first separation zone, are passed to alkylation unit 10. The $C_5+$ gasoline product from the first separation zone, amounting to 16,584 kg/hr is passed to storage or used as desired, e.g. blended with the alkylate produced in unit 10. The separated $C_5+$ gasoline product is analyzed and found to have a RON-clear of 92.6, a MON-clear of 78.4 and a bromine number of 96.

The first fractionator of unit 2, as noted before, is charged with 16,696 kg/hr of ethylene and 3,095 kg/hr of propylene from unit 4 and an ethylene/propylene recycle stream amounting to 3,350 kg/hr of ethylene and 9,675 kg/hr of propylene obtained from the effluent of the disproportionation reactor of unit 2. After separation, one stream consisting of 18,720 kg/hr of ethylene and 280 kg/hr of propylene is passed to cleavage unit 4. The bottoms, amounting to 1,326 kg/hr of ethylene and 12,490 kg/hr of propylene are combined with 3,510 kg/hr of propylene obtained from an exterior source such as a refinery stream and the combined stream is passed to the disproportionation reactor of unit 2. The effluent from the reactor, comprising 3,350 kg/hr of ethylene, 9,675 kg/hr of propylene, 4,175 kg/hr of butenes and 126 kg/hr of $C_5+$ entrained in the ethylene/propylene stream from the first separation zone is passed to the second fractionator of unit 2. The separated ethylene/propylene stream is recycled to the first fractionator of unit 2. The butenes and the $C_5+$ gasoline bottom product are combined with the butenes and isobutane obtained as a product of unit 4 and the combined stream is sent to alkylation zone 10.

Alkylation unit 10 is charged with 7,793 kg/hr of isobutane obtained from an exterior source such as a refinery stream and the combined streams comprising butenes from the first and second separation zones. A high octane alkylate effluent is obtained from unit 10 which is found to have a RON-clear of 97.5 and a MON-clear of 94.3.

The alkylate can be blended with the $C_5+$ product from unit 4 to produce a gasoline having a RON-clear value of about the same value as the cat cracker gasoline feed. However, the MON-clear value is found to average about 3–4 units higher than the value of the cat cracker gasoline feed. The road ratings as defined by RON +2 MON/3 indicate the combined gasoline is 2–4 units higher in value than the cat cracker feed. The volume the combined gasoline is about 25% greater than the volume of the cat cracker gasoline before it is treated in the cleavage unit.

The process of the invention is of particular value when upgrading cat cracker gasoline is desired in situations where a propylene stream is available but a pure ethylene stream is not and/or a diisopropyl unit is not available.

Clean separation of ethylene and propylene by fractionation is not required in the instant invention thus reducing separation costs. Therefore, an ethylene/propylene stream, the major portion of which is ethylene, is adequate in the cleavage unit to react with the olefins in the gasoline to produce butenes.

In the process according to the invention it is not necessary to make a clean separation of ethylene and propylene in the effluent from the cleavage unit. This is an economic advantage of the invention.

Although propylene has been indicated as the sole external feed to disproportionation unit 2 one skilled in the art will understand that there may be some ethylene in the propylene stream supplied to unit 2.

In the example, the propylene stream consumed in the reactions comprises about 20 weight percent propylene obtained from an external source such as a refinery stream and about 80 weight percent recycle propylene obtained from cleavage zone (unit) 4, the ethylene stream obtained from disproportionation zone (unit) 2 comprises about 98.5 weight percent ethylene and about 1.5 weight percent propylene, and the butenes consumed in alkylation zone (unit) 10 comprise about 40 weight percent derived from the cleavage zone and about 60 weight percent derived from the disproportionation zone.

Reasonable variation and modification are possible in the scope of the foregoing disclosure, the drawing and the appended claims to the invention the essence of which is that there has been provided a combination of steps, as described, including disproportionation of propylene to produce ethylene and butenes subjecting ethylene thus obtained together with a catalytic cracking gasoline to cleavage in the presence of a disproportionation catalyst to produce a stream containing propylene and ethylene, which is fed to the disproportionation, a $C_5+$ or gasoline component containing stream and a stream containing butenes which together with a stream containing butenes obtained in the disproportionation is passed to an alkylation wherein an isoparaffin e.g. isobutane is alkylated therewith to produce high octane value gasoline components.

I claim:

1. A process for producing high octane value gasoline which comprises in a disproportionation zone subjecting propylene and a mixture of propylene and ethylene obtained as hereinafter delineated to disproportionation conditions to produce a stream containing ethylene and a stream containing butenes, passing the ethylene-containing stream from said disproportionation zone together with a catalytic cracking gasoline to a cleavage zone under disproportionation conditions and subjecting the mixture of hydrocarbons therein to cleavage to produce said mixture of propylene and ethylene, a $C_5+$ gasoline-containing product and butenes and wherein the butenes obtained in the overall operation of the disproportionation zone and the cleavage zone are passed to an alkylation zone wherein said butenes are used to alkylate an isoparaffin to produce additional high octane value product.

2. A process according to claim 1 wherein the propylene passed to said disporportionation zone is composed of about 80 weight percent propylene cycled in said mixture of propylene and ethylene obtained from the cleavage zone and wherein said stream containing ethylene obtained from said disproportionation zone contains of the order of about 98–99 weight percent ethylene and of the order of about 1.5 weight percent propylene and wherein the butenes passed to said alkylation zone comprise 40 weight percent derived from said cleavage zone and about 60 weight percent derived from said disproportionation zone.

* * * * *